US008567860B2

(12) United States Patent
Jue

(10) Patent No.: US 8,567,860 B2
(45) Date of Patent: Oct. 29, 2013

(54) COMBINATION BACKPACK-LUGGAGE-CHAIR WITH INTEGRAL LUMBAR SUPPORT

(76) Inventor: Ambert Jue, Sunnyvale, CA (US)

( * ) Notice: Subject to any disclaimer, the term of this patent is extended or adjusted under 35 U.S.C. 154(b) by 162 days.

(21) Appl. No.: 13/034,582

(22) Filed: Feb. 24, 2011

(65) Prior Publication Data

US 2012/0217773 A1 Aug. 30, 2012

(51) Int. Cl.

| | |
|---|---|
| ***A47C 4/00*** | (2006.01) |
| ***A47C 13/00*** | (2006.01) |
| ***A47C 4/52*** | (2006.01) |
| ***A47C 7/62*** | (2006.01) |

(52) U.S. Cl.
USPC ..... 297/19; 297/53; 297/129; 297/183.5; 297/188.06; 297/188.14

(58) Field of Classification Search
USPC ..... 297/16.1, 17, 19, 411.32, 188.14, 129, 297/53, 188.06, 183.5; 190/8
See application file for complete search history.

(56) References Cited

U.S. PATENT DOCUMENTS

| | | | | |
|---|---|---|---|---|
| 119,162 | A * | 9/1871 | Lutz | 280/37 |
| 1,002,305 | A * | 9/1911 | Pattinson | 297/19 |
| 1,275,649 | A * | 8/1918 | Blando | 297/17 |
| 4,201,416 | A | 5/1980 | Vanderminden | |
| 4,514,009 | A | 4/1985 | Vanderminden et al. | |
| 5,289,958 | A * | 3/1994 | Jay | 224/155 |
| 5,310,208 | A * | 5/1994 | Jarke et al. | 280/643 |
| 5,409,291 | A | 4/1995 | Lamb et al. | |
| D412,407 | S | 8/1999 | Tseng | |
| 5,975,389 | A * | 11/1999 | Braun et al. | 224/155 |
| 6,012,769 | A * | 1/2000 | Hsueh et al. | 297/19 |
| 6,820,928 | B1 * | 11/2004 | Ransom | 297/29 |
| 6,840,574 | B1 * | 1/2005 | Wu | 297/45 |
| 8,016,089 | B1 * | 9/2011 | McNichols | 190/8 |
| 2007/0089952 | A1 * | 4/2007 | Herbst et al. | 190/8 |

* cited by examiner

*Primary Examiner* — Milton Nelson, Jr.

(57) ABSTRACT

A multipurpose folding chair is disclosed. The chair includes a frame that may be configured for a variety of applications. Locking mechanisms may secure leg portions, a backrest portion, and a footrest portion of the chair in multiple positions relative to a seat of the chair. The chair may be configured to receive a container such as a backpack. In the container receiving configuration, a shoulder strap of the container may be used to carry both the container and the chair. The chair may be equipped with wheels to facilitate portability. The chair includes an integral lumbar support element to support the back of the user. The chair may be optionally equipped with a footrest, armrests, and/or a headrest.

20 Claims, 19 Drawing Sheets

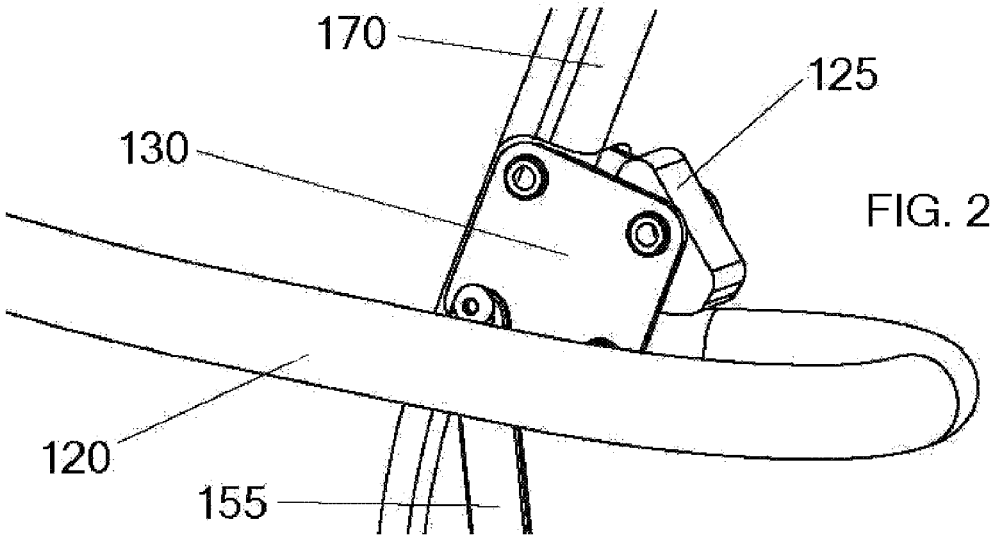
FIG. 2A
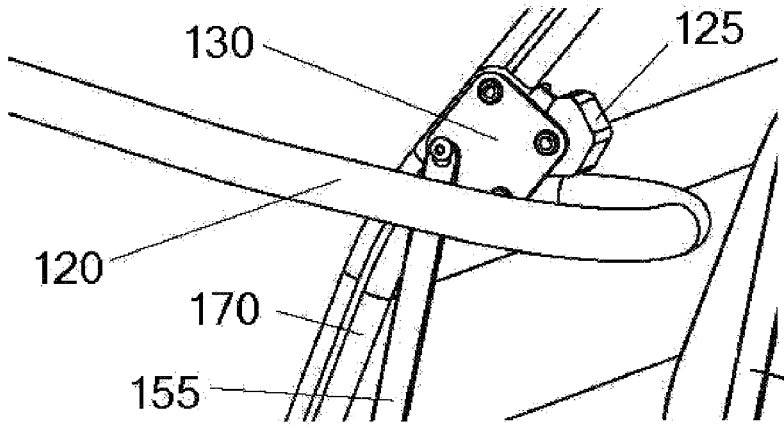
FIG. 2B
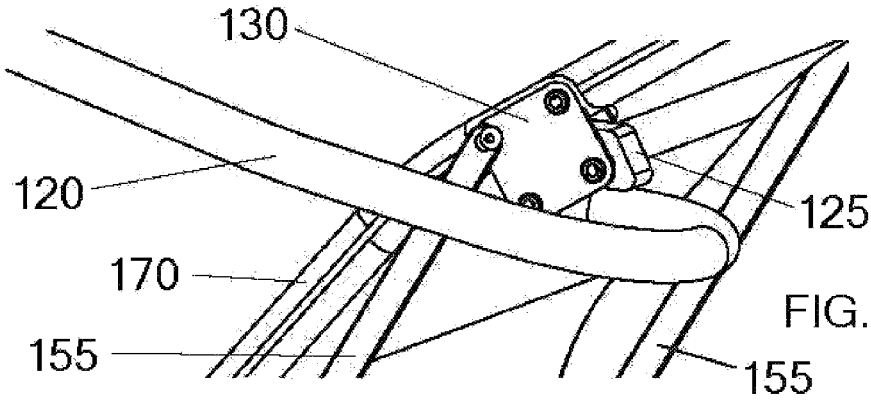
FIG. 2C
FIG. 2

COMBINATION BACKPACK-LUGGAGE-CHAIR WITH INTEGRAL LUMBAR SUPPORT

BACKGROUND OF THE INVENTION

1. Field of the Invention

The present invention relates generally to chairs. The invention more particularly is a combined folding chair, backpack, and luggage. The device includes a lumbar support element that is utilized when the device is used as a chair.

2. Description of the Prior Art

Prior art folding chairs are cumbersome and require users to carry their chairs and backpacks separately. Most prior art folding chairs also require the user to carry their food, drinks, and other paraphernalia separately from their chair. Most folding chairs require separate storage bags to carry the chair itself, or they may require the user to use a free hand to grab an exposed frame section in order to hold the chair itself. Sometimes the prior art folding chairs require the user to hold a dangerously exposed or protruding bar of the chair in order to transport it. The prior art folding chairs tend to unfold in a multitude of ways from a multitude of locations while being carried or transported.

Beach chairs are typically constructed with a plurality of lightweight metallic tubular members with a fabric or plastic webbing stretched across the members in order to form a seat section and a back section. Generally, these chairs are changeable from a closed position to an extended deployed position. The closed position typically minimizes the amount of storage space required when the chair is not in use, and facilitates portability. The extended position allows a backrest portion, a seat portion, and a leg assembly portion to be deployed or extended from the folded position of the frame. This type of chair is carried to a desired location by grasping some part of the chair or by packing the closed chair into a storage container bag that generally includes straps.

Accordingly, there is a need for a chair that provides improved lumbar support, greater ease of transport and use, and greater carrying capacity. The chair should have a lightweight construction, fewer non-functional attributes, and more functional applications to adequately meet user needs.

SUMMARY OF THE CLAIMED INVENTION

Various embodiments of the present invention include a frame that is adjustable between a closed position and at least one deployed position. The frame is configurable to a plurality of modes, each mode being adapted to a desired function. The chair may include a seat bottom, a seatback, and a compartment to secure a container. The chair may also include an integral lumbar support element, the lumbar support element being formed at least in part by a portion of the frame. The chair may further include a footrest that moves between a deployed position and a stowed position. The chair device may further include one or more armrests that may include cup holders. The seatback portion of the frame pivots to a plurality of positions relative to the seat portion of the frame. The legs of the chair may also be made to pivot to a plurality of positions, thereby allowing the chair to be configured to provide multiple seating elevations to accommodate varying user heights.

Other embodiments of the present invention may include a chair and container device in combination. In the combination device, the device includes a frame that is adjustable between a closed position and at least one deployed position. The frame is configurable to a plurality of modes, each mode being adapted to a desired function. The frame also includes a seat bottom portion and a seatback portion, the seat bottom portion and the seatback portion being configurable to form a compartment that receives the container. The combination device may further include a clamping assembly to removably attach the container to the frame.

BRIEF DESCRIPTION OF THE DRAWINGS

It will be noted that corresponding reference numbers in the drawings indicate corresponding parts throughout the several views of the drawings.

FIGS. 2A-C are detail views of a hinging and positioning mechanism.

FIG. 3A is a detail view of a snap button.

DETAILED DESCRIPTION

Various embodiments of the present invention disclose a combined backpack-luggage-chair. The device may be configured to perform multiple functions, and is easily transportable. In various configurations, the device may be used as a beach chair, campsite chair, a picnic chair, lawn chair, rickshaw chair, and carry-on luggage, to mention but a few examples.

Figure 1:
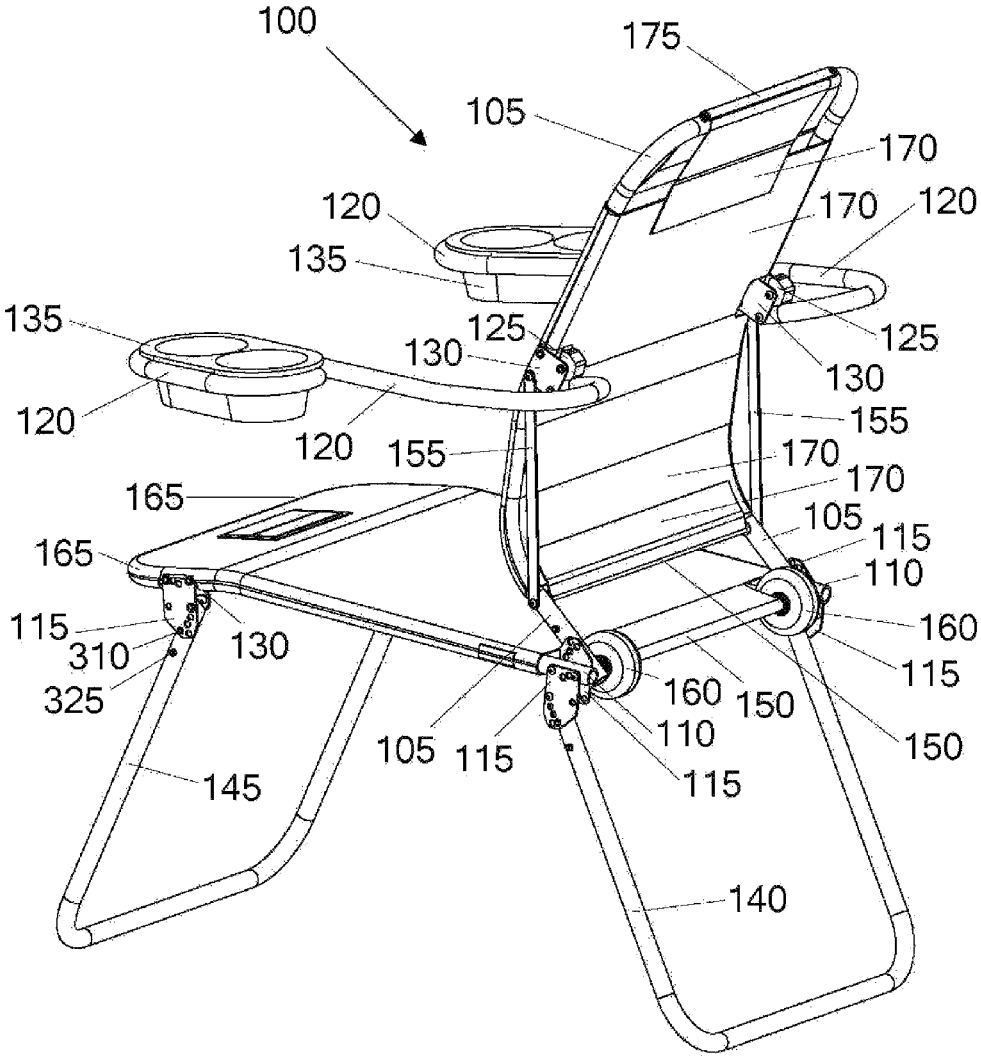
FIG. 1 is a perspective view of an embodiment of a multi-function chair as described herein.

Referring first to FIG. 1, a multi-function, transportable chair 100 includes a seatback frame portion 105. The seatback frame 105 is pivotally attached to a seat bottom frame 110. In various embodiments of the invention, one or more adjusting brackets 115 may be utilized to secure the seatback frame 105 at a desired variable angle relative to the seat bottom frame 110. The operation of the adjusting brackets 115 is described in further detail below. When the chair 100 is configured in a standard seat mode as depicted in FIG. 1, the seatback frame 105 may be deployed at an approximately 90 degree angle to the seat bottom frame 110. In this position, the chair 100 has an ergonomically efficient and lumbar supportive "L" shaped seating position. With the use of adjusting brackets 115 the chair may also be made to accommodate the heights of various users by raising and lowering the seat bottom frame 110 via the adjusting brackets 115.

The chair 100 may include left and right armrests 120 rotatably attached to the seatback frame 105. Armrest positioners 125, along with brackets 130, may be used to limit the rotation of the armrests 120 relative to the seatback frame 105 and to hold the armrests 120 in a desired position relative to the seatback frame 105. The operation and construction of the positioners 125 and brackets 130 are illustrated in further detail in FIGS. 2A-C.

The positioners 125 may be rotatably mounted in a bracket 130 and constructed substantially as an irregular three-dimensional polygon. By constructing the positioners 125 so that the distances between the center pivot points and the edges of the positioners 125 vary, the positioners 125 can be used to support the armrests 120 in multiple positions. FIG. 2A shows the positioner 125 in a position that provides a maximum separation distance and angle between the armrests 120 and the seatback frame 105, so that the armrests 120 may be positioned horizontal and parallel to the seat bottom frame 110 regardless of the recline angle of the seatback frame 105, which is nearly upright in FIG. 2A. FIG. 2B shows a medium position in which the seatback frame 105 is partially reclined, and FIG. 2C shows a position in which the seatback frame 105 is fully reclined. Note that in all three positions, the armrest 120 is held in a substantially horizontal orientation.

The armrests 120 may be constructed with an opening at a distal end that is sized and shaped to receive cup holders 135. The cup holders 135 are secured in the openings of the armrests 120 by a friction fit. If desired, a user may remove the cup holder 135 from the armrest 120 to accommodate drinking glasses or cups that are too large for the receptacles in the cup holders 135. With the cup holder 135 removed, the larger cups are received directly in the opening in the end of the armrest 120.

At or near the pivot point of the seatback frame 105 and the seat bottom frame 110 a rear leg assembly 140 is pivotally attached. At or near a front end of the seat bottom frame 110, a front leg assembly 145 is pivotally attached. The rear and front leg assemblies 140, 145 may be U-shaped as illustrated in FIG. 1, but any configuration that provides adequate support and stabilization for the chair 100 can be utilized.

The rear and front leg assemblies 140, 145 are attached to the seat bottom frame 110 by one or more adjusting brackets 115. As with the seat back frame 105 and the seat bottom frame 110, the adjusting brackets 115 allow the angle of the leg assemblies 140, 145 relative to the seat bottom frame 110 to be varied as desired and as is appropriate for a given configuration of the chair 100. Various configurations of the chair 100 will be described in further detail below.

Figure 3:
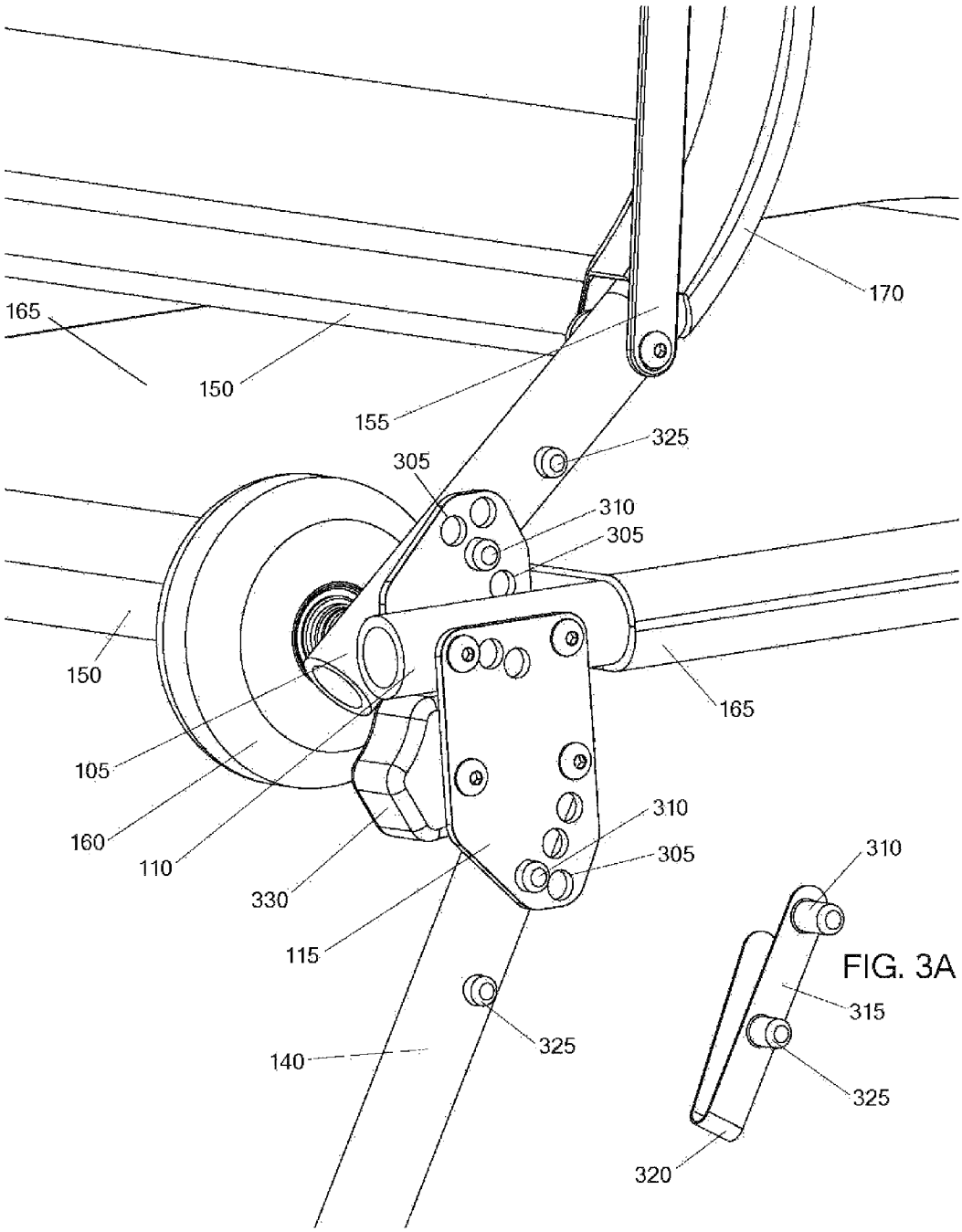
FIG. 3 illustrates an adjustable positioning mechanism.

Various mechanisms for the adjusting brackets 115 can be chosen by the user. In the embodiment shown in FIG. 1, and in greater detail in FIGS. 3 and 3A, the adjusting brackets 115 are provided with a series of holes 305 that receive a head 310 of a snap button 315. The angle at which the two connected elements are fixed is determined by which of the holes 305 receives the head 310. The snap button 315 is held in place by a doubled-over base strip 320 that may be formed from a flexible metal. The doubled-over portion of the base strip 320 fills the interior of the tubular frame member, thereby holding the snap button 315 in place. The position of the snap button 315 is further secured by a pin head 325 that is received in a corresponding hole in the tubular member in which the snap button 315 is being employed. Pressure generated by the doubled-over portion of the base strip 320 urges the pin head 325 into the corresponding hole in the tubular member. To change the position of the tubular member, the user simply pushes the pin head 325 of the snap button 315, which moves pin head 310 out of the hole 305 in which it had been secured, thereby allowing the user to move the tubular member to the desired position, at which point the pin head 310 of the snap button 315 is received in an appropriate hole 305.

A supporting positioner 330 may be utilized to assist in the positioning function of the adjusting brackets 115. The supporting positioner 330, as is the case with the positioner 125, may be rotatably mounted on the adjusting bracket 115 and constructed substantially as an irregular three-dimensional polygon. By constructing the supporting positioners 330 so that the distances between the center pivot points and the edges of the supporting positioners 330 vary, the supporting positioners 330 can be used to support the two tubular members being joined (typically the leg assemblies 140, 145 to the seat bottom frame 110) in multiple angles relative to each other.

One or more transverse frame braces 150 may be installed in the frame of the chair 100. The frame braces 150 add to the structural integrity of the frame of the chair 100, and also serve as convenient attachment points for various elements as described below. A pair of reinforcing bars 155 may also be added at the lower end of the seatback frame 105. It should be noted that the lower end of the seatback frame 105 may be arced to provide superior lumbar support as compared to prior art chairs. The reinforcing bars 155 may span the lumbar support region of the seatback frame 105 to provide structural strength to the frame.

Figure 4:
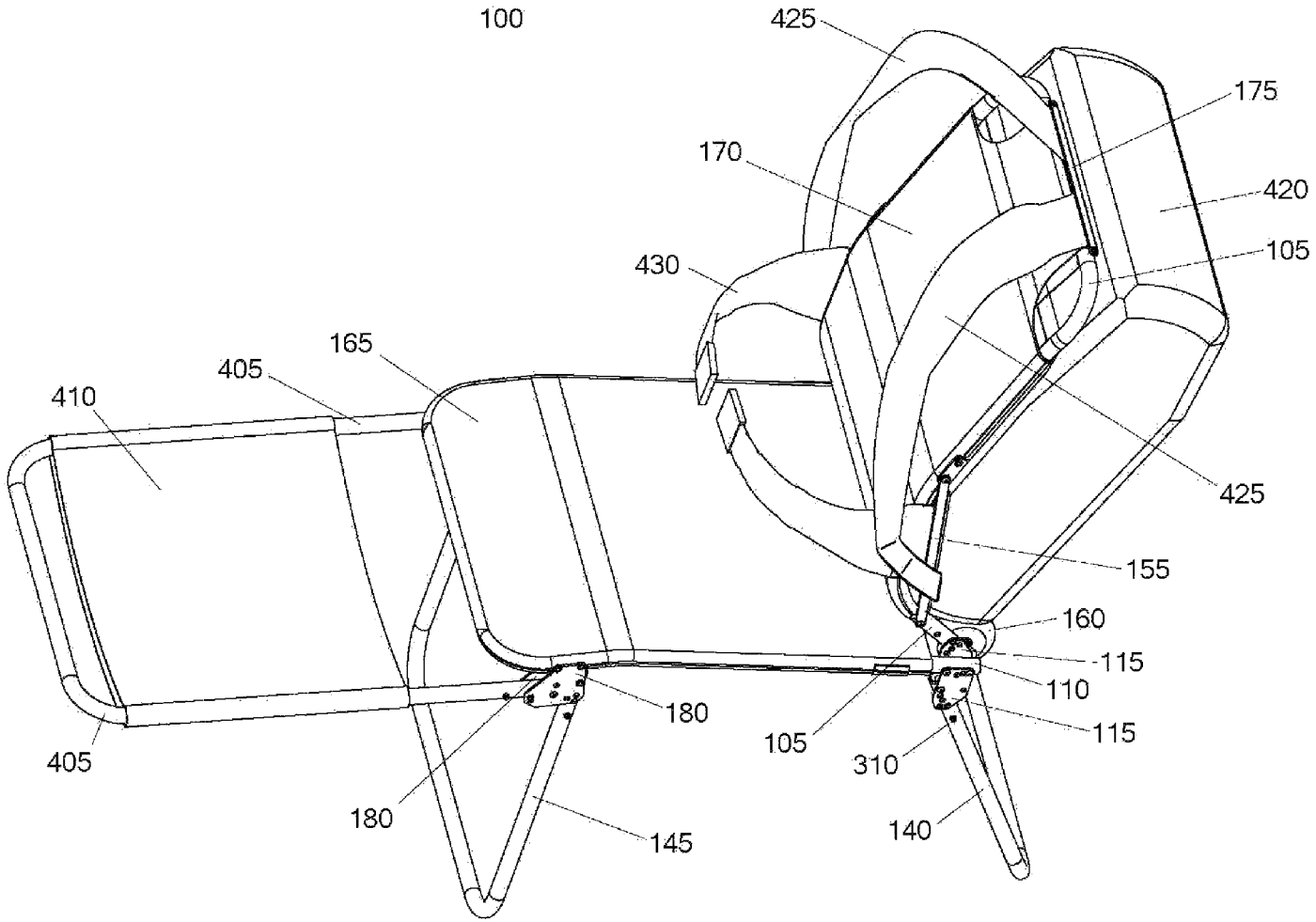
FIG. 4 illustrates the chair with a footrest.

FIG. 4 illustrates an embodiment of the chair 100 with a footrest 400 added to the seat bottom frame 110. The frame 405 of the footrest 400 may be a U-shaped member like the other frame elements, or the footrest frame 405 may simply include a pair of extendable rods. The footrest 400 may be attached to the seat bottom frame 110 or the front leg assembly 145.

A set of wheels 160 may be installed on the frame brace 150 at or near the pivot point of the seatback frame 105 relative to the seat bottom frame 110. The frame brace 150 serves as an axle for the wheels 160. The wheels 160 may be utilized to provide greater mobility to the chair 100 in various embodiments as described below. Skate wheels are but one example of a wheel suitable for this purpose.

The seatback frame 105, the seat bottom frame 110, and the footrest elements 405 may each be covered either partially or completely by a fabric element. A footrest fabric cover 410, which may be constructed so as to be removable, may include an opening 415. Either the opening 415 or the footrest 405 may serve as a handle to pull or carry the chair 100 in various configurations.

A seat bottom cover 165 may be used on the seat bottom frame 110, and a seatback cover 170 may be used on the seatback frame 105. It will be understood by those skilled in the art that any or all of the fabric elements may include pockets for storage and Velcro sections to assist in securing the fabric elements to the frame of the chair 100 or to other elements, or for securing external elements to the chair 100.

A clamping assembly constructed with one or more clamping bars 175 may be utilized to further secure the fabric elements, or a backpack, to the frame of the chair 100. The clamping bars 175 are typically removably attached to the frame, but can be permanently secured by an adhesive or the like if desired by the user. In various embodiments, the clamping bars 175 will be secured by easily removable elements so that the clamping bars 175 can easily be removed and installed by hand from the seatback frame 105.

FIG. 4 also illustrates a combination of the chair 100 with a backpack 420. While it is envisioned that a backpack generally be deployed in the device, it will be understood by those skilled in the art that any type of luggage or other container may be utilized herein. While for purposes of clarity and ease of description, the device will be described herein with reference to a backpack, the description is in no way intended to limit the device to only a backpack. Any object with a storage area may be utilized.

Figure 5:
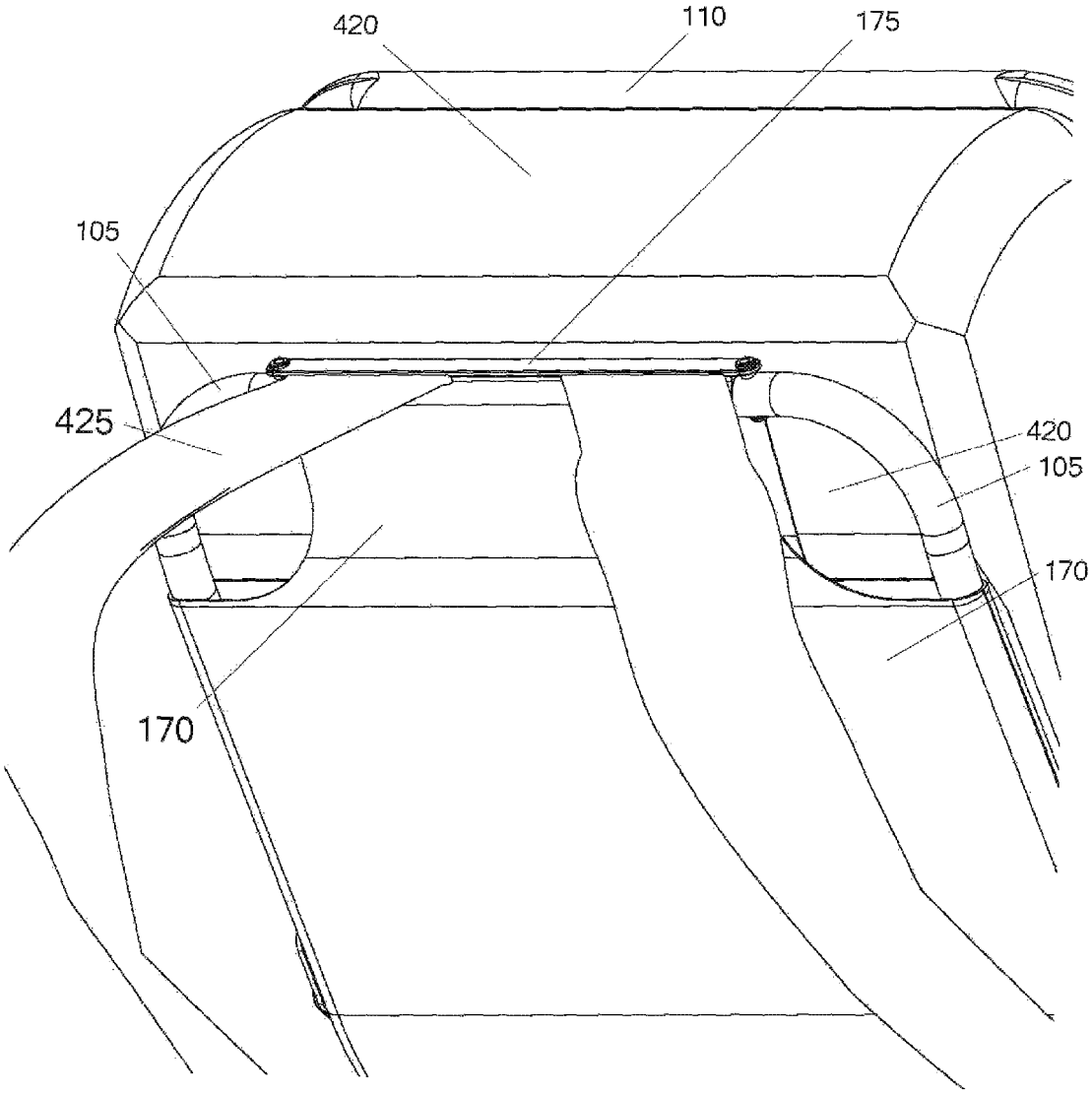
FIG. 5 shows a mechanism for attaching a backpack to the chair.

As illustrated in greater detail in FIG. 5, the top of the backpack 420 may be secured by temporarily removing/releasing one side of the clamping bar 175, placing shoulder straps 425 over the top of the seatback frame 105, and replacing the clamping bar 175. The clamping bar 175 may then be secured to the seatback frame 105. If desired, the clamping bar 175 and may be permanently secured with an appropriate adhesive, so that the backpack 420 is permanently attached to the chair 100.

Figure 6:
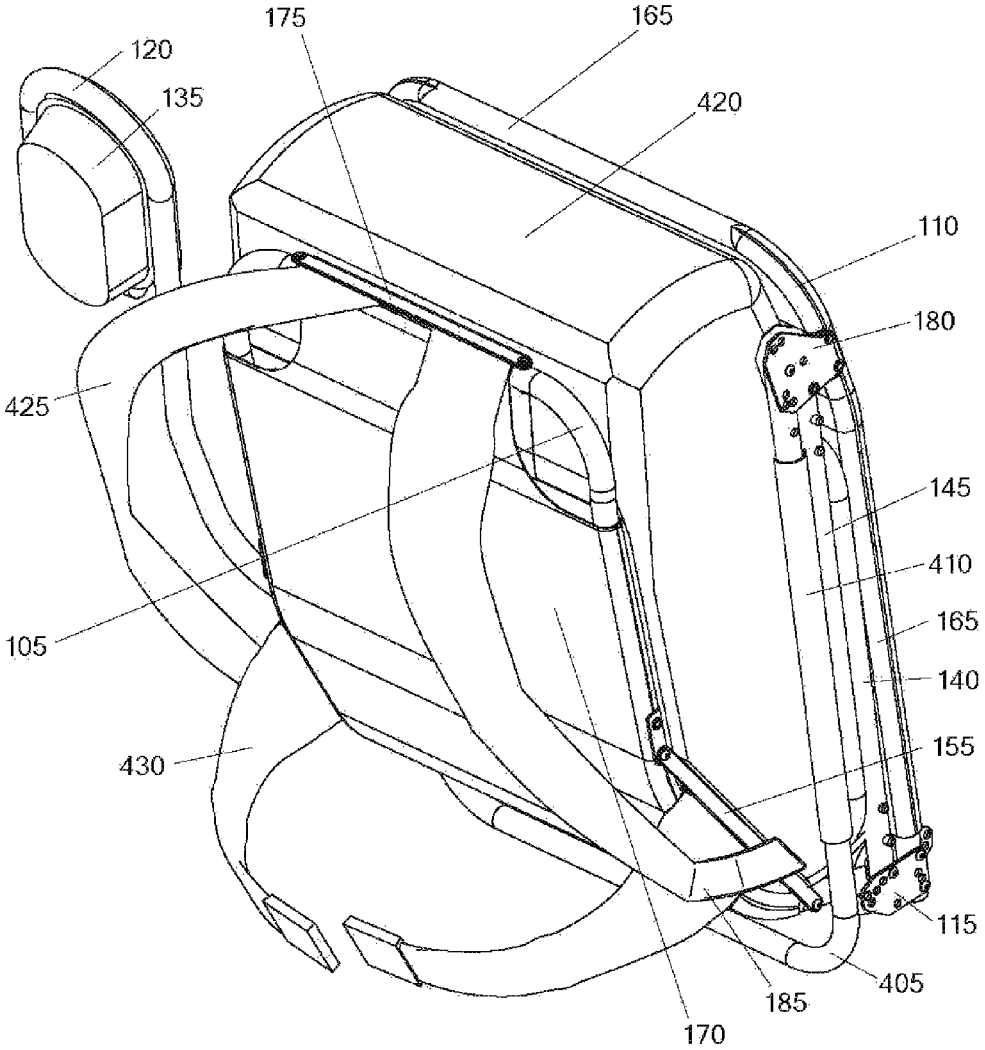
FIG. 6 illustrates a chair/backpack combination.
Figure 7:
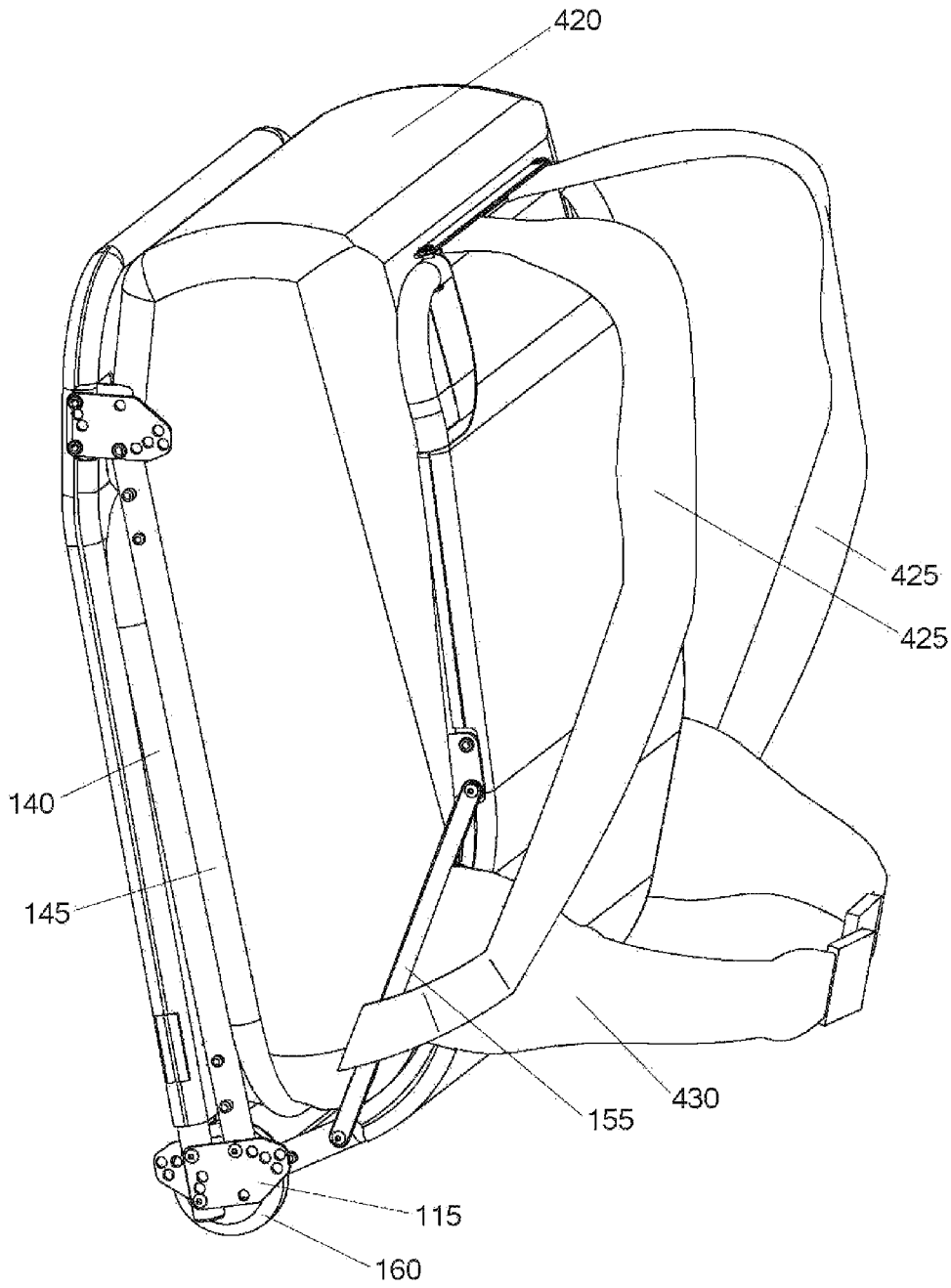
FIG. 7 is another perspective view of a chair/backpack combination.

FIGS. 6 and 7 illustrate the chair 100 in combination with the backpack 420 as the combination might be used in a backpack mode. The user slips his arms through the shoulder straps 425 and fastens the belt 430 around his waist. The seatback frame 105 rests on the back of the user, protected by the seatback cover 170. When the backpack 420 is installed in the chair 100, lateral motion of the backpack 420 is inhibited by the reinforcing/clamping bars 155 attached to the seatback frame 105. Many, if not most, backpacks also include a waist belt 430. The belt 430 may be threaded through the opening between the reinforcing bars 155 and the seatback frame 105 to further secure the backpack 420. Alternatively, the clamping bars 155 may also be threaded through the loops made between the stitches 185 of the backpack, and then mounted to seatback frame 105, so as to secure the lower part of the backpack to the frame. With these connections in place, the backpack 420 is very securely fastened to the chair 100.

The backpack 420 is received in a compartment bounded by the wheels 160, and/or the backside of the seat bottom frame 110, the upper end of the seatback frame 105, and the backside of the seatback frame 105. The other frame elements of the chair 100—the footrest 400, the front leg assembly 145, the rear leg assembly 140, and the seat bottom 110—are folded against the back of the backpack 420. The result is a compact package that takes little more space than the backpack itself, yet allows the user to transport a multi-purpose folding chair as well as forming a protective structure for the contents of the backpack 420. FIG. 6 also shows that if desired by the user, the armrests 120 and cup holders 135 may be utilized while the device is in backpack mode. FIG. 7 illustrates that the wheels 160 do not significantly add to the footprint of the device.

Figure 8:
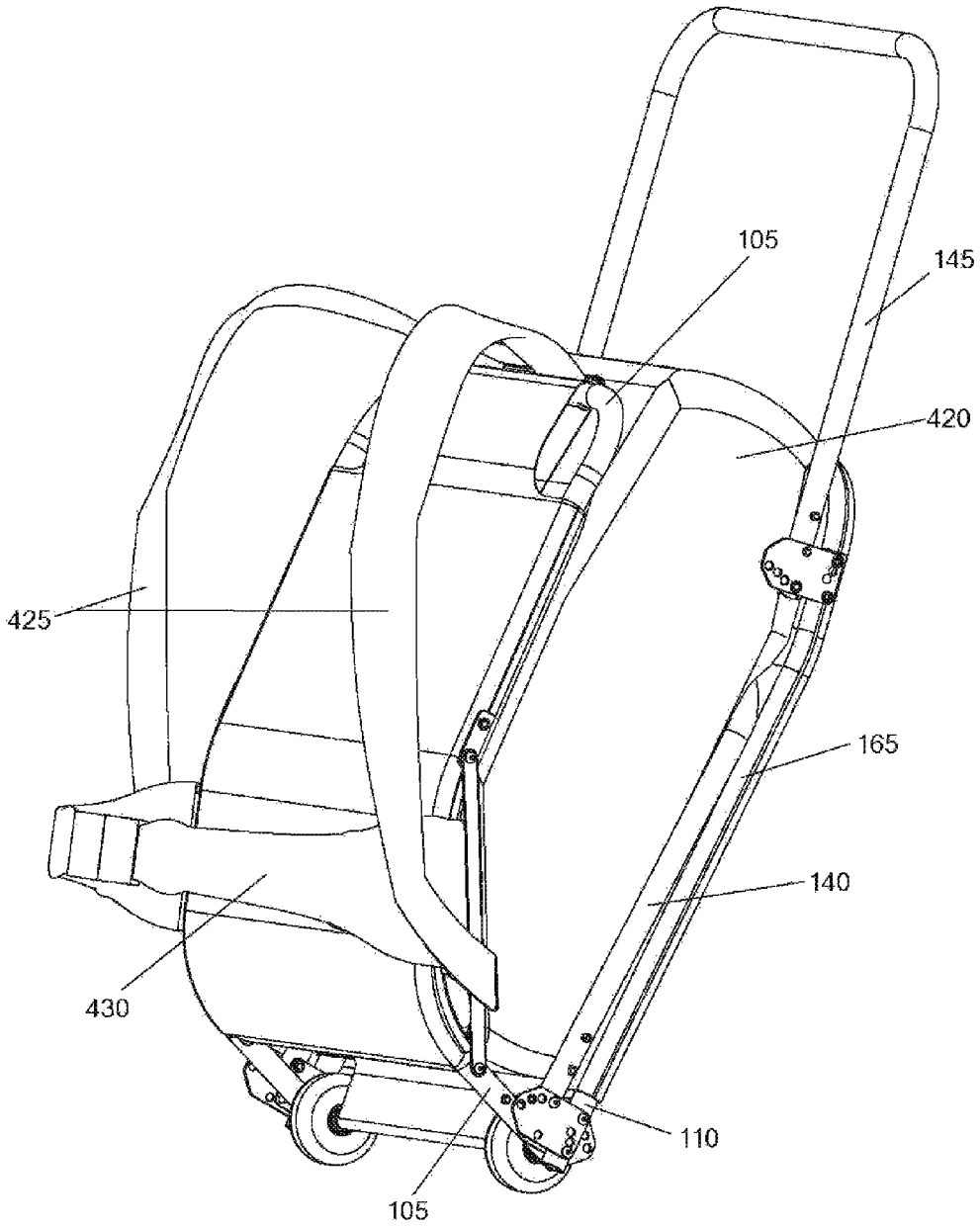
FIG. 8 illustrates the chair deployed as rolling luggage.

FIG. 8 illustrates the chair/backpack combination as employed in rolling luggage mode. In this mode, the front leg assembly 145 is extended to serve as a handle.

Figure 9:
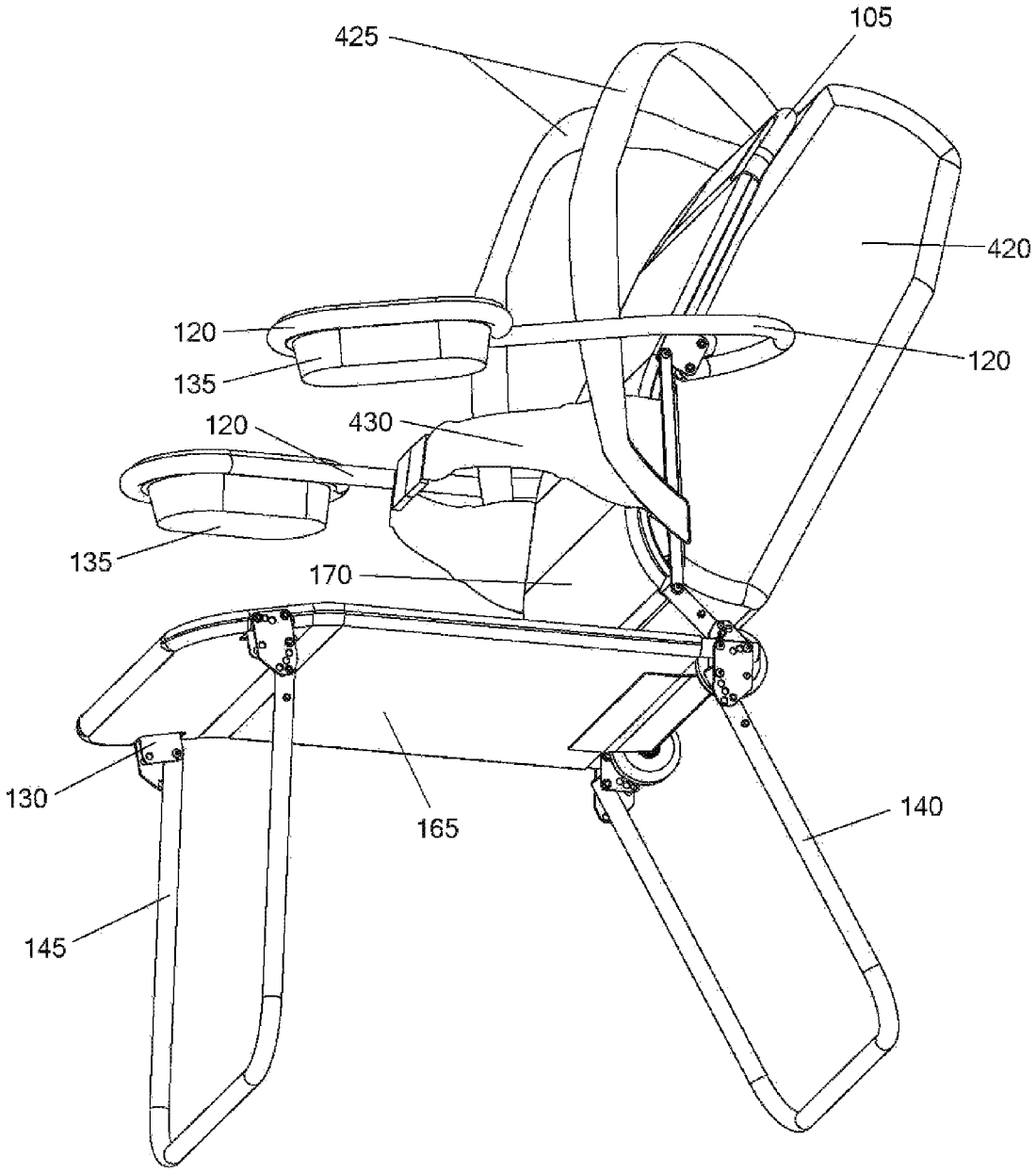
FIG. 9 illustrates a chair/backpack combination with the leg assemblies of the chair extended.
Figure 10:
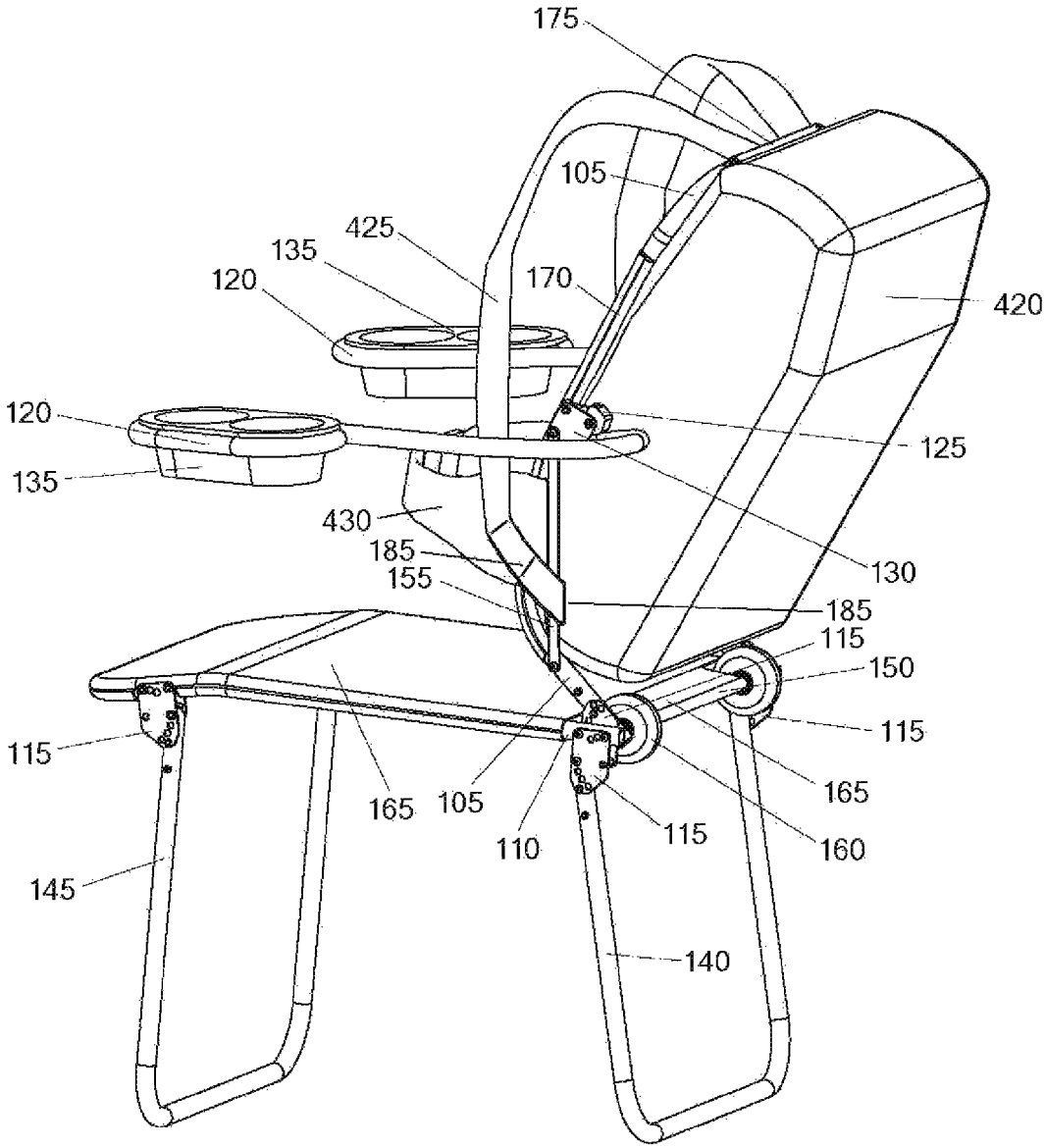
FIG. 10 shows another perspective view of the chair/backpack combination.

FIGS. 9 and 10 show the chair/backpack combination in beach chair mode. FIG. 9 also displays the Velcro flap, between the wheels 160, that secures the seat cover 165 and opens and closes the seat container formed within the chair fabric 165. The leg assemblies 140, 145 are extended to support the chair. The backpack 420 may remain in position affixed to the chair 100. Armrests 120 may then be employed as shown in FIG. 1, with the backpack 420 seated between the square armrest brackets 130.

Figure 11:
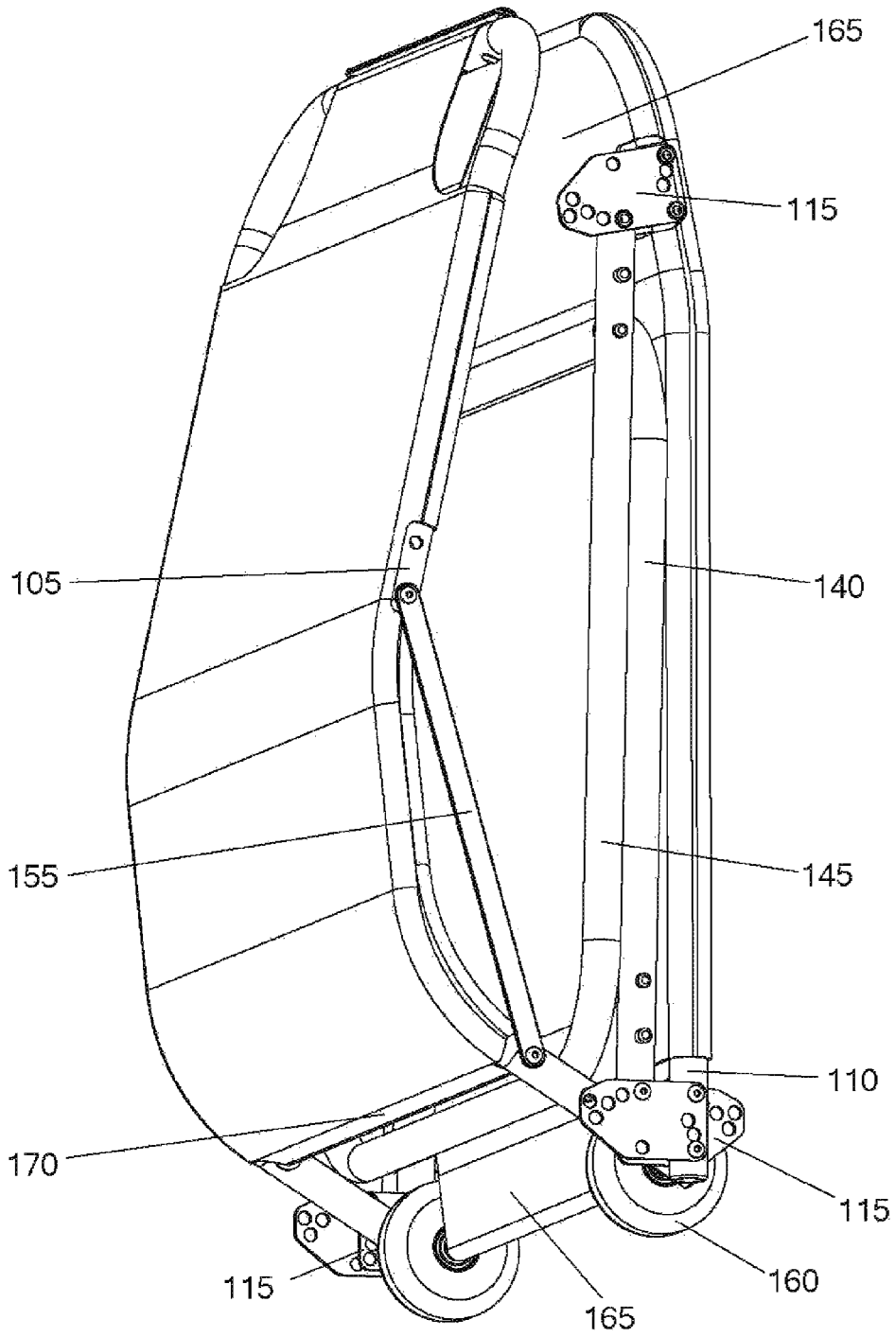
FIG. 11 illustrates a view of the chair in a fully closed position.

FIG. 11 shows the chair 100 in a closed configuration in which storage space is minimized. The chair/backpack combination is thereby configured so that it is readily received in overhead storage compartments of airplanes.

Figure 12:
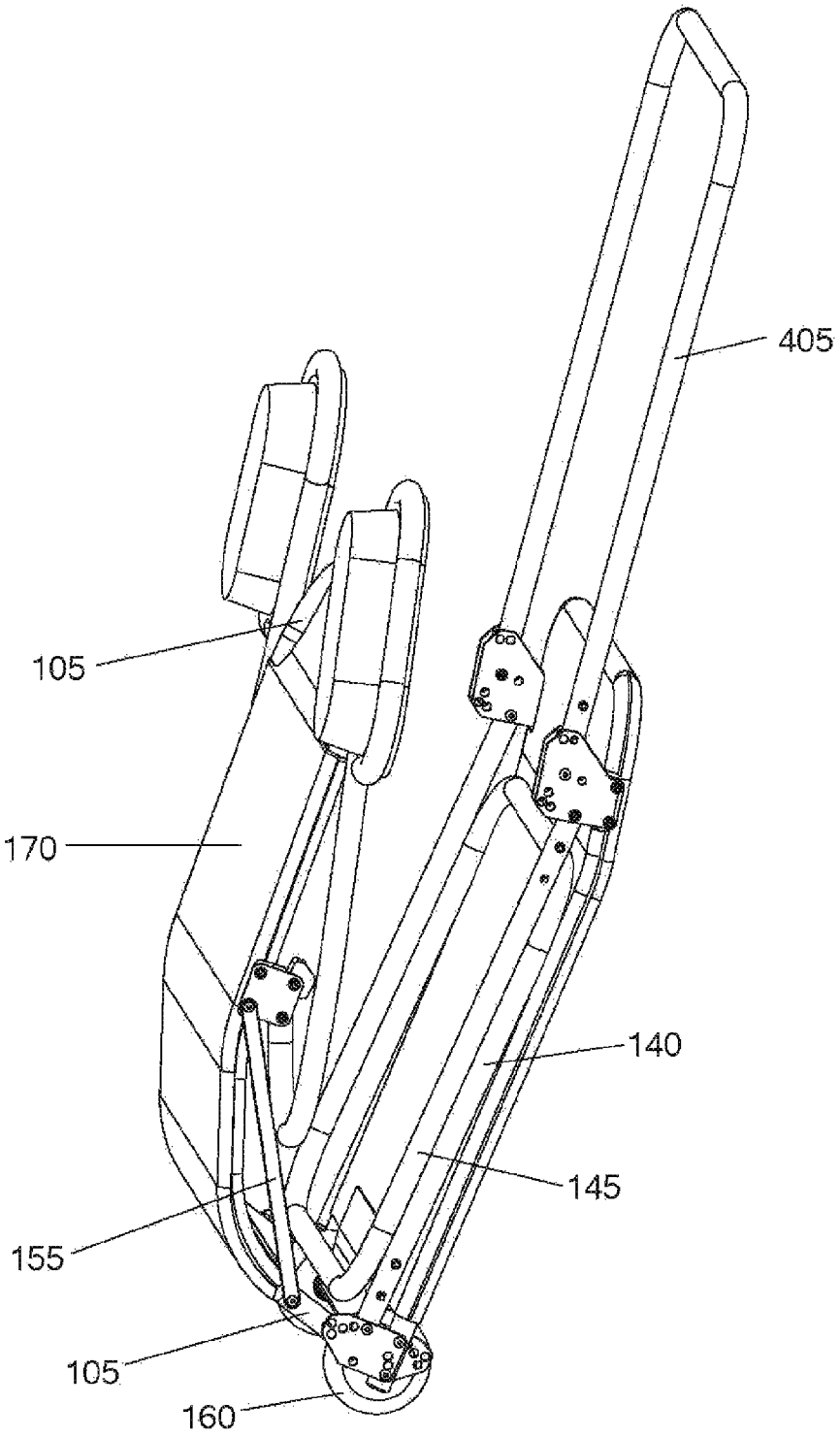
FIG. 12 shows the chair in a carrier mode.

FIG. 12 illustrates the chair 100 in a partially open stroller luggage mode in which an item to be transported may be placed in an open space between the seat bottom frame 110 and the seatback frame 105. If the footrest fabric element is removed, then the footrest frame elements 405 may be operated independently, allowing the footrest to be used as a stand for the stroller luggage mode or as a handle. When removed, the footrest fabric cover 410 may be stowed within the container beneath the seat shown in FIG. 9.

Figure 13:
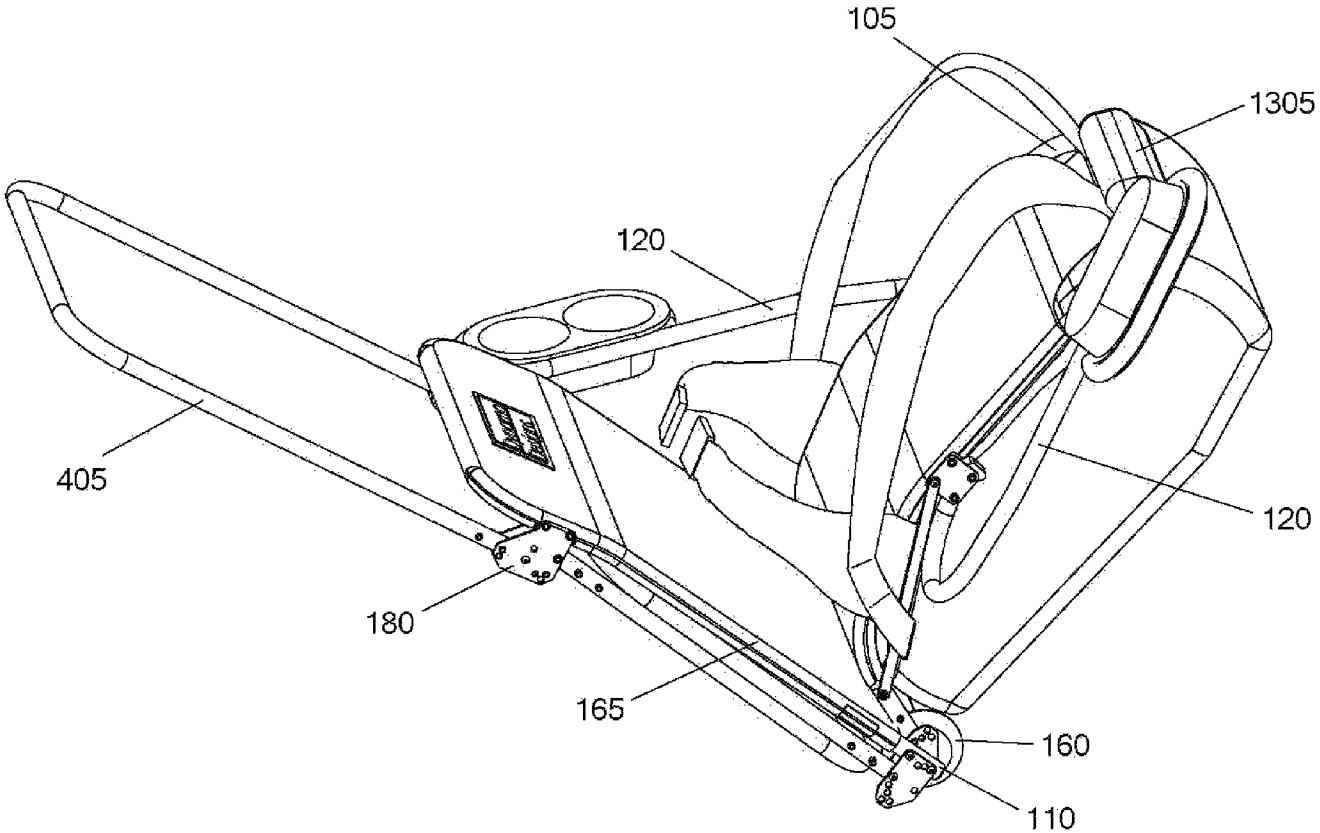
FIG. 13 illustrates the chair deployed in a rickshaw mode.

FIG. 13 illustrates the chair 100 in a rickshaw mode. In this mode, a person seated in the chair 100 may be transported by another person. The tubular members of the footrest 405 may be extended to provide the transporting person with convenient hand grips. A headrest 1305 may be added to the chair 100 if desired by the user. The headrest 1305 may be secured by Velcro, straps, or any other convenient fastening mechanism.

Figure 14:
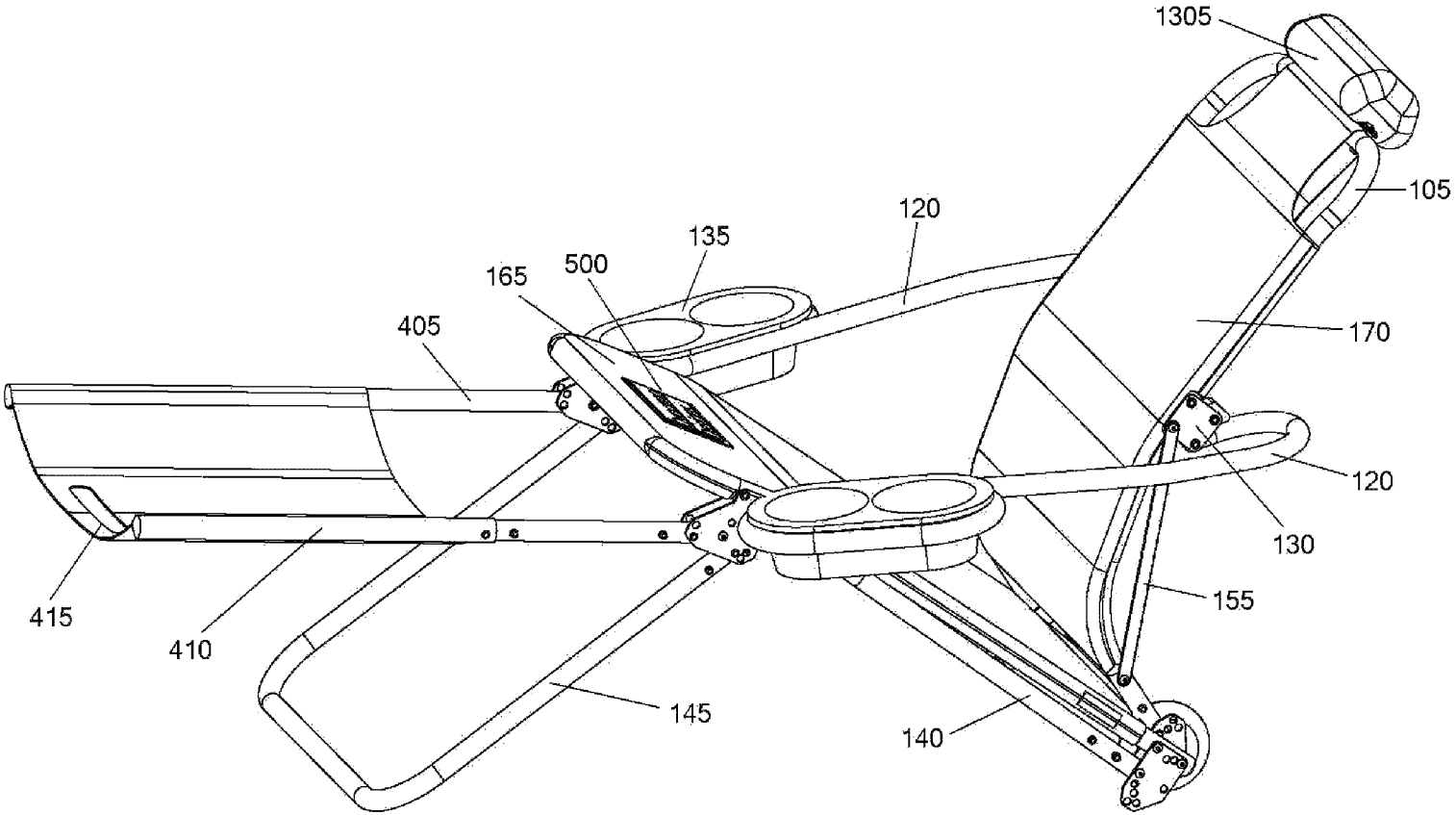
FIG. 14 illustrates the chair deployed in a lawn chair mode.

FIG. 14 shows the chair in an "equilibrium" lawn chair mode in which the rear leg assembly 140 is folded up underneath the seat bottom frame 110. The rear leg assembly 140 may be held in place with external straps. The opening 415 in the footrest cover 410 may be used as a handle for moving the chair in this mode or for moving the luggage in the stroller luggage mode.

Figure 15:
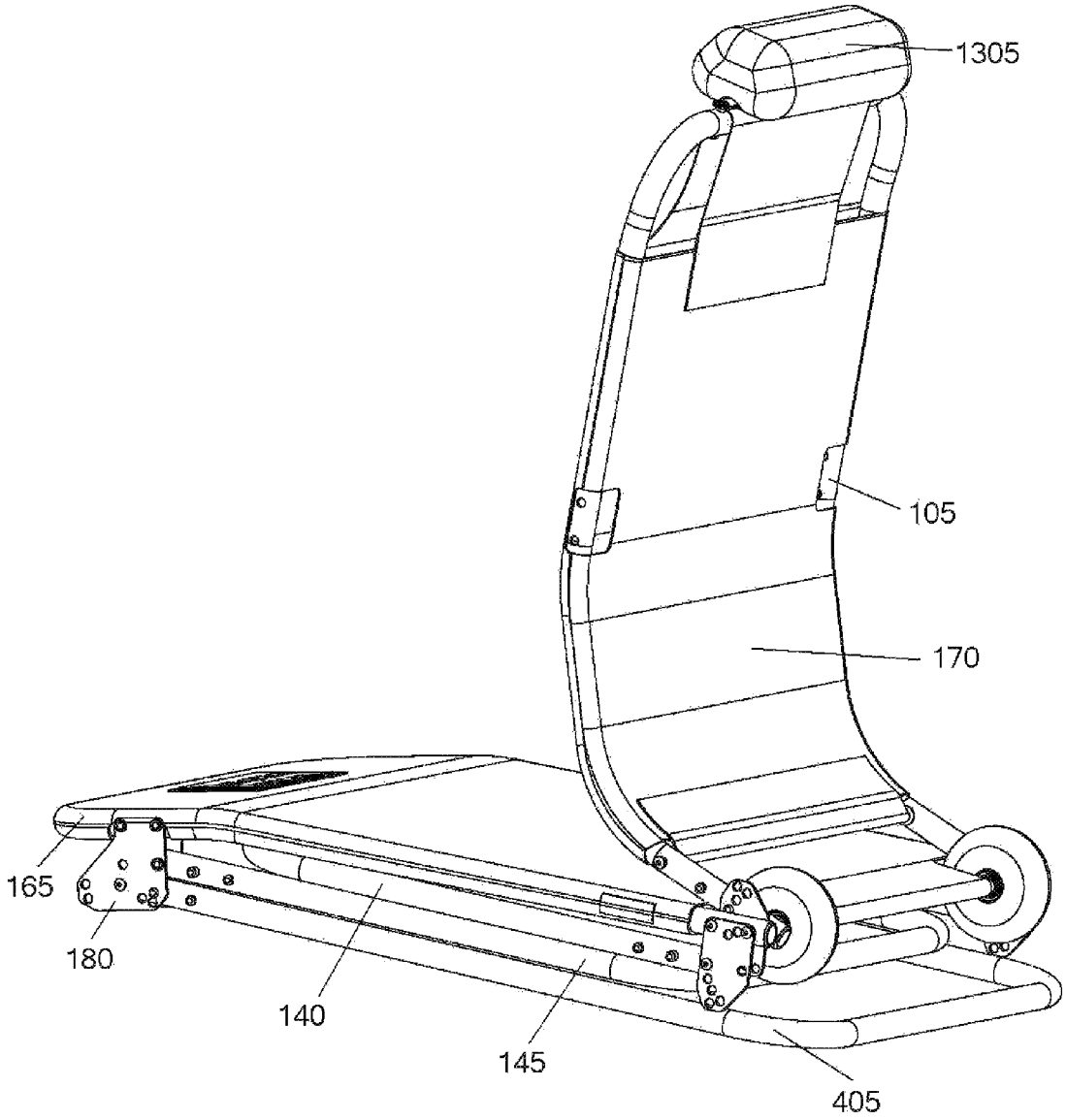
FIG. 15 shows the chair in a yoga or beach chair mode.

FIG. 15 shows the chair in a yoga or beach chair mode. In this mode, the footrest 400, the front leg assembly 145, and the rear leg assembly 140 are all folded to a position generally parallel to the seat bottom frame 110. In this mode, the seat bottom frame 110 essentially rests on the ground, separated from the ground only by the stowed footrest 405, front leg assembly 145, and rear leg assembly 140.

Figure 16:
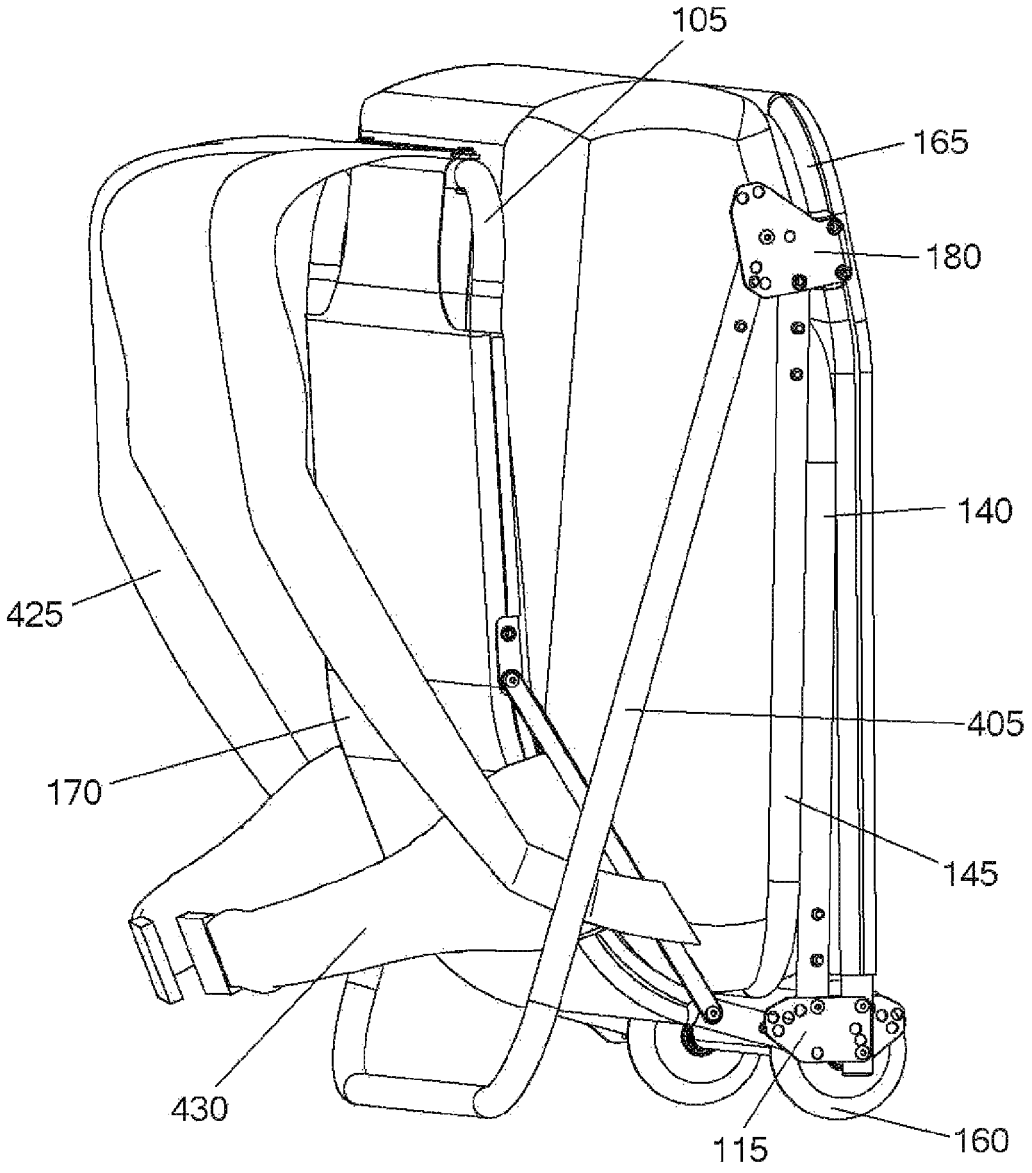
FIG. 16 shows the chair/backpack combination with a footrest deployed as a stand.

FIG. 16 shows the chair with the U-shaped footrest element 405 utilized as a stand.

Figure 17:
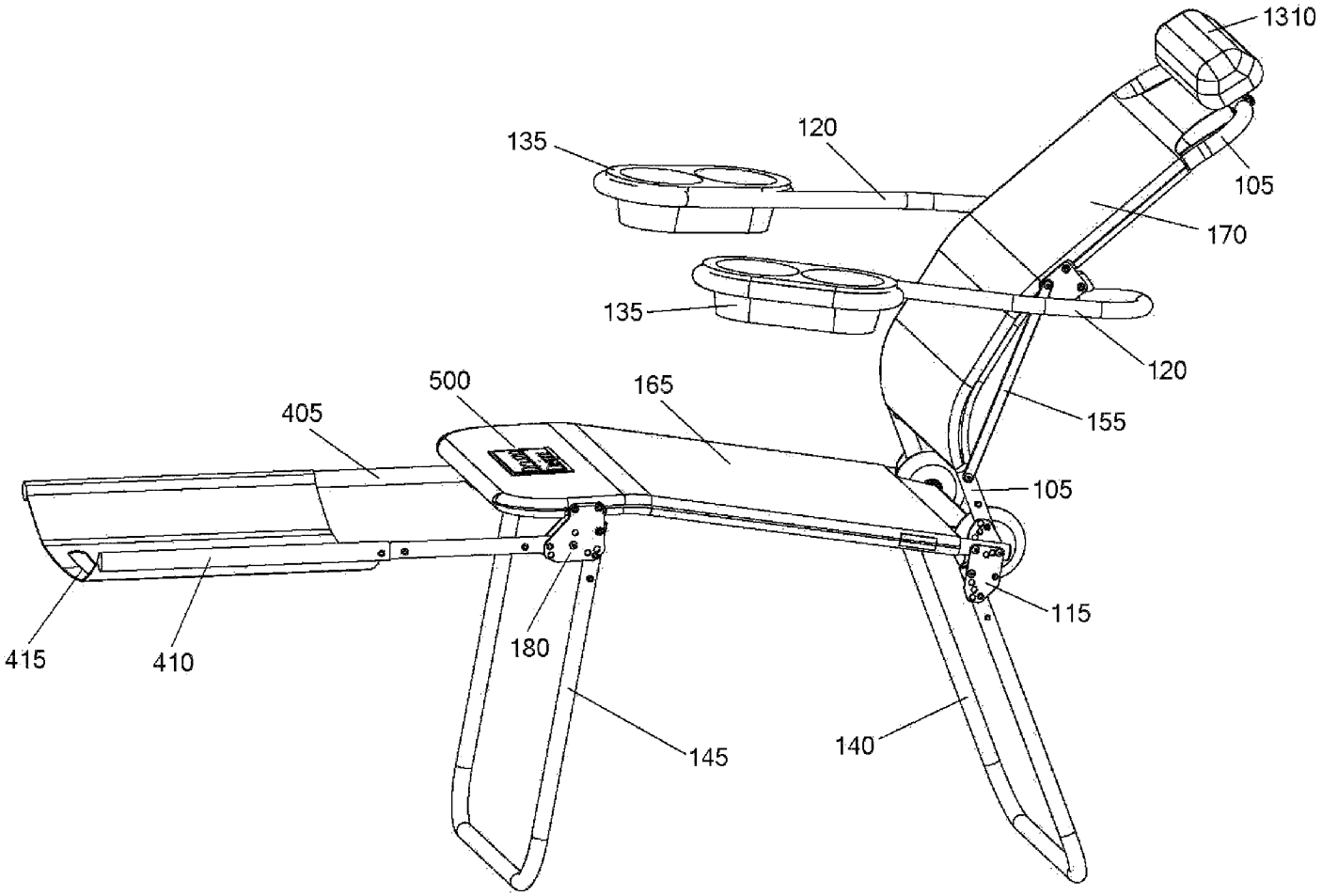
FIG. 17 illustrates the chair being used as a recliner.

FIG. 17 shows the chair used as a recliner with the two footrest elements 405 extended and covered over by footrest cover 410. The opening 415 in footrest cover 410 may be used as a handle.

Figure 18:
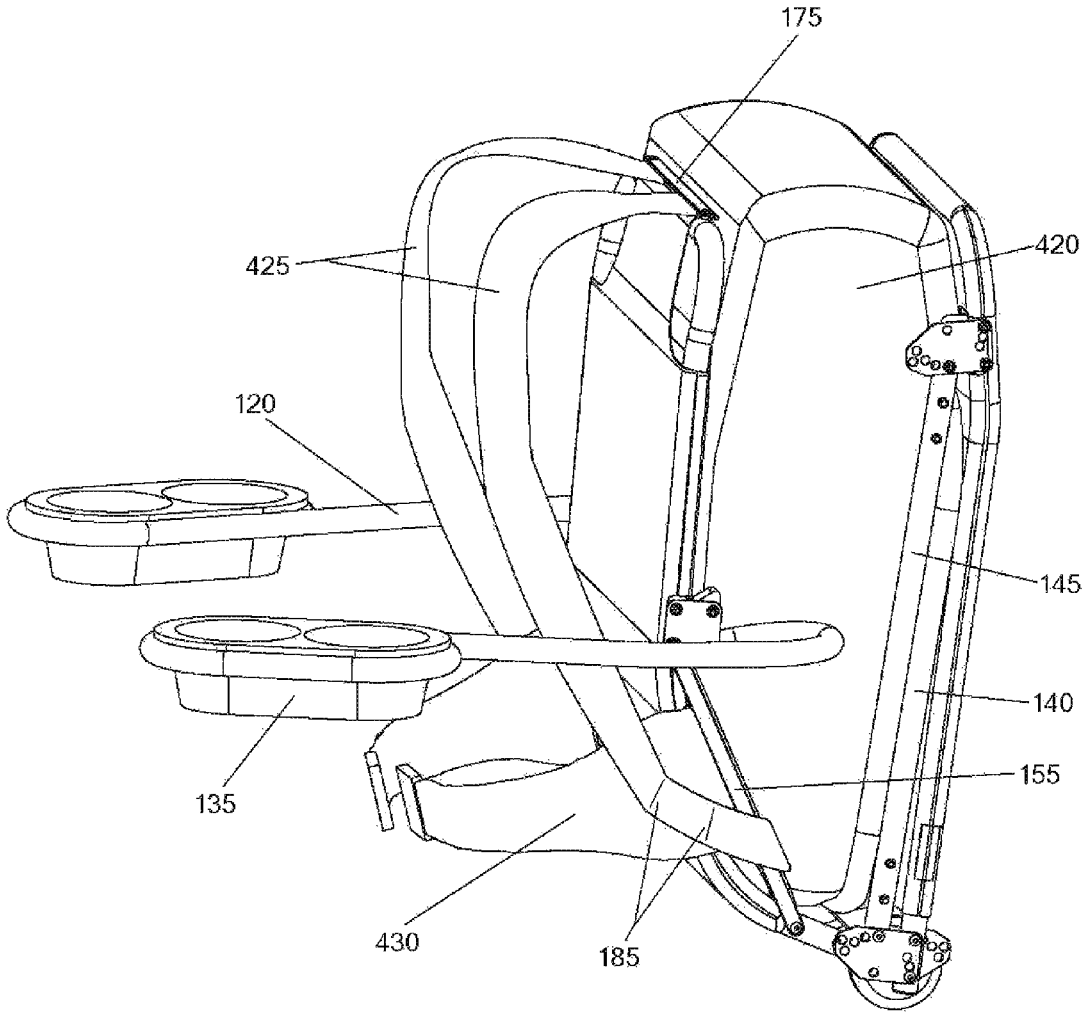
FIG. 18 shows the chair/backpack combination with cup holders.

FIG. 18 shows the chair/backpack combination with armrests 120 deployed to free the hands of the user. The cup holders 135 and armrests 120 may be used to carry drinks or other paraphernalia.

Figure 19:
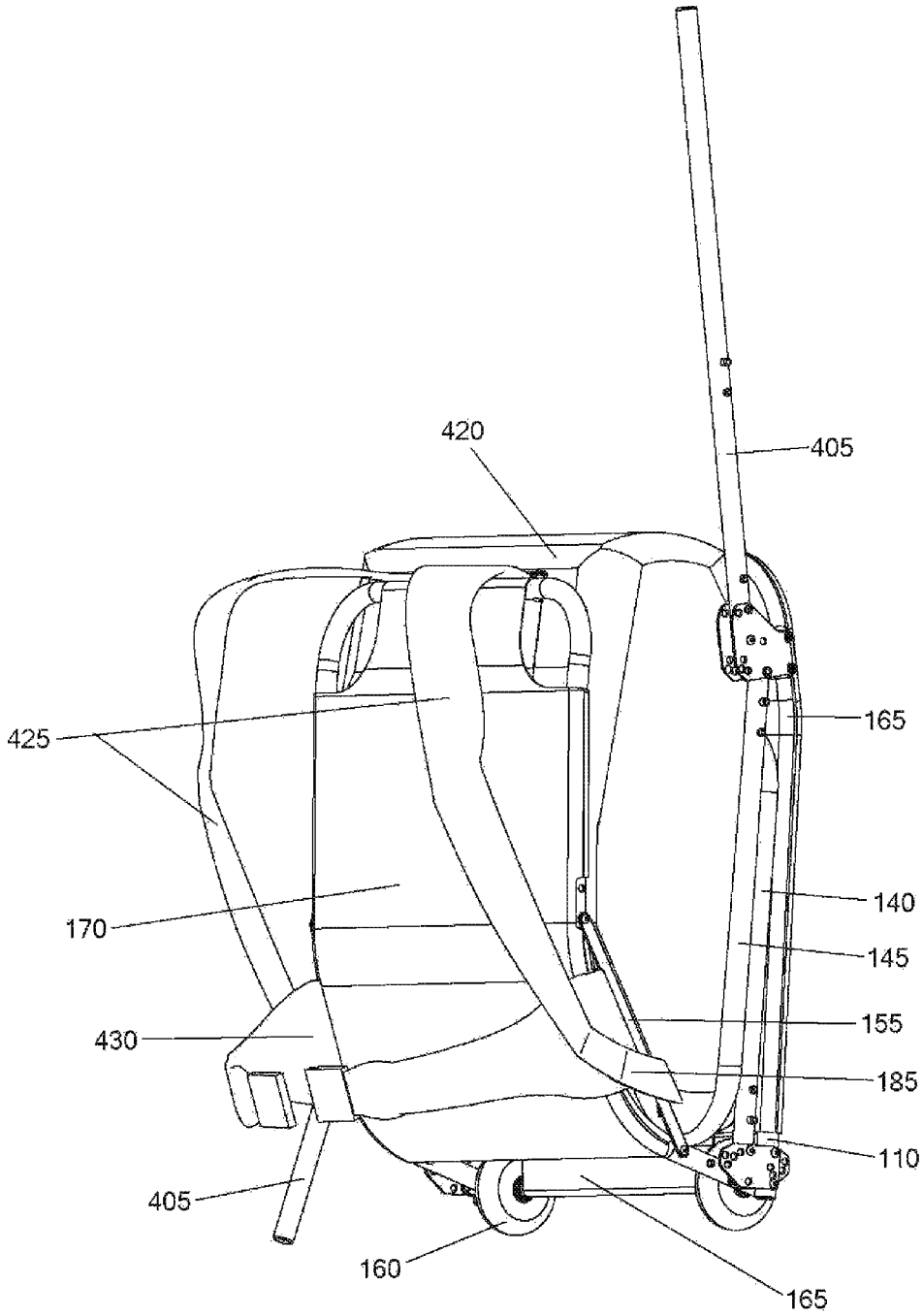
FIG. 19 illustrates the chair/backpack combination with one footrest element being used as a stand and one footrest element being used as a handle.

FIG. 19 shows the backpack carrier with two separate footrest elements 405 without the fabric cover 410. Without the footrest fabric cover 410, the footrest frame elements 405 may be operated independently, allowing one frame element 405 to be used as a stand for the stroller luggage mode while the other is used as a handle. The footrest fabric cover 410 may be stowed within the container beneath the seat shown in FIG. 9.

The frame members of the chair 100 are typically formed from tubular aluminum. It will be readily recognized by those skilled in the art that other materials and shapes may be utilized to construct the chair 100 as described herein. The fabric elements covering the frame members may similarly be constructed from a variety of suitable materials. While the fabric elements may generally be constructed from Nylon, plastic, or Polyester, other materials may be utilized with equal facility.

The embodiments described herein are illustrative of the present invention. As these embodiments of the present invention are described with reference to illustrations, various modifications or adaptations of the methods and or specific structures described may become apparent to those skilled in the art in light of the descriptions and illustrations herein. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A chair device comprising:

a frame fabricated using a hollow pipe of a rigid material and having a first portion and a second portion, the first portion is configured to receive a seat bottom and the second portion is configured to receive a seatback, each of the first portion and the second portion having a first end and a second end, wherein the first portion and the second portion are adjoined together, through a coupling, at their respective first ends, the first portion and the second portion having a folding axis approximate to where the first portion and the second portion adjoins, the frame being adjustable between a closed position and at least one deployed position, wherein, in the at least one deployed position, the first portion and the second portion are configured to be positioned at an angle to each other, the frame being configurable to a plurality of modes, each mode being adapted to a preselected function; and wherein, in at least one of the plurality of modes, the first portion and the second portion are configured to form an at least partially enclosed compartment, for carrying a foreign object, wherein the coupling includes an adjustment bracket having a plurality of holes to receive a snap button head mounted on a doubled-over base strip made of a flexible metal, the doubled-over base strip is housed inside the hollow pipe and the snap button head protrudes out of the hollow pipe through a hole in the hollow pipe, the plurality of holes in the adjustment bracket are configured such that only one of the plurality of holes is configured to receive the snap button head at a time and each of the plurality of holes on the adjustment bracket is configured to provide a different angle between the first portion and the second portion, wherein the second portion includes a lumbar support for securing back support material and a part of the second portion is contoured.

2. The chair device of claim 1, further comprising wheels mounted on the frame approximate to an axis where the first portion and the second portion meet.

3. The chair device of claim 1, wherein the second portion pivots to a plurality of positions relative to the first portion, wherein a number of the plurality of positions is equal to a number of holes in a plurality of mate-able holes of the adjustment bracket and wherein the snap button head received in one of the plurality of holes secures the second portion in one of the plurality of positions.

4. The chair device of claim 1, wherein the frame further includes a forward leg assembly portion, the forward leg assembly portion of the frame pivots to a plurality of positions relative to the first portion, and wherein a forward leg locking mechanism including a second bracket having a second set of plurality of holes and a second doubled-over base strip having a second snap button head secures the forward leg assembly in each of the plurality of positions.

5. The chair device of claim 1, wherein the doubled-over base strip including a second snap button head that is configured to protrude through a second hole in the hollow pipe, wherein the second snap button head does not touch the adjustment bracket.

6. The chair device of claim 1, further comprising a clamping assembly coupled to the second end of the second portion, to removably attach a container to the frame, thereby securing the container in a position in which a strap of the container is used to carry both the container and the chair device.

7. The chair device of claim 1, further comprising an adjustable armrest coupled to the second portion through an second adjustment bracket, wherein an irregular three-dimensional polygon shape armrest positioner is rotatably mounted on the second adjustment bracket, the irregular three-dimensional polygon shape armrest positioner has a plurality of sides and a hole going through the width of the irregular three-dimensional polygon shape armrest positioner for receiving a mounting hardware, wherein the adjustable armrest is configured to be adjustable through a rotation of the irregular three-dimensional polygon shape armrest positioner.

8. The chair device of claim 7, wherein the adjustable armrest is configured to move between a deployed position and a stowed position.

9. The chair device of claim 1, where the at least partially enclosed compartment is configured to receive a backpack or a container.

10. The chair device of claim 9, further comprising a bar that is secured to the second end of the second portion through at least two removable fasteners to secure straps of the backpack or container.

11. The chair device of claim 1, further comprising a leg assembly coupled to the first portion through a second adjustment bracket having a second set of a plurality of holes to receive a second snap button head mounted on a second doubled-over base strip made of the flexible metal, the second doubled-over base strip is housed inside the hollow pipe and the second snap button head protrudes out of the hollow pipe through a second hole in the hollow pipe, the second set of plurality of holes in the second adjustment bracket are configured such that only one of the second set of the plurality of holes is configured to receive the second snap button head at a time and each of the second set of the plurality of holes on the second adjustment bracket is configured to provide a different angle between the first portion and the leg assembly.

12. The chair device of claim 11, further comprising a footrest, wherein the footrest is coupled to the first portion and the leg assembly through the second adjustment bracket at a coupling of the first portion and the leg assembly, the footrest that moves between a deployed position and a stowed position.

13. The chair device of claim 11, wherein the first adjustment bracket and the second adjustment bracket are configured to put the first portion, the second portion and the leg assembly into a configuration that creates a compartment to receive a container.

14. A chair and container device comprising:

a frame fabricated using a hollow pipe of a rigid material and having a first portion and a second portion, each of the first portion and the second portion having a first end and a second end, wherein the first portion and the second portion are adjoined together, through a coupling, at their respective first ends, the first portion and the second portion having a folding axis approximate to where the first portion and the second portion adjoins, the frame being adjustable between a closed position and at least one deployed position, the frame being configurable to a plurality of modes, each mode being adapted to a desired function, the frame including a seat bottom portion and a seatback portion, the seat bottom portion and the seatback portion being configurable to form a compartment for carrying a foreign object and the chair being configurable to be transformed into a carrying case, the seat bottom portion and the seatback portion are moveably adjoined together through the coupling; and an independently adjustable chair leg portion coupled to the frame, wherein the chair leg portion being configurable to be transformed into a handle for the carrying case, wherein the coupling includes an adjustment bracket having a plurality of holes to receive a snap button head mounted on a doubled-over base strip made of a flexible metal, the doubled-over base strip is housed inside the hollow pipe and the snap button head protrudes out of the hollow pipe through a hole in the hollow pipe, the plurality of holes in the adjustment bracket are configured such that only one of the plurality of holes is configured to receive the snap button head at a time and each of the plurality of holes on the adjustment bracket is configured to provide a different angle between the seat back portion and the seat bottom portion.

15. The chair and container device of claim 14, further comprising a clamping bar attached to a distal second end of the seatback portion through removable fasteners.

16. The chair and container device of claim 14, further comprising a lumbar support element, the lumbar support element being formed at least in part by a contoured portion of the frame, wherein the lumbar support element is configurable to receive back support material within the seatback portion.

17. The chair and container device of claim 14, further comprising wheels attached to the frame approximately where the first portion and the second portion meet.

18. The chair and container device of claim 17, wherein in at least one configuration, a portion of the frame extends upward from the frame to serve as a handle.

19. The chair and container device of claim 17, wherein in at least one deployed position, the frame being configurable as a chair.

20. A chair device comprising:

a frame fabricated using a hollow pipe of a rigid material and having a first portion and a second portion, the first portion is configured to receive a seat bottom and the second portion is configured to receive a seatback, each of the first portion and the second portion having an adjoining first end and a distal second end, wherein the first portion and the second portion are moveably adjoined at their first ends, through a coupling, together at their respective adjoining ends, the frame being adjustable between a closed position and at least one deployed position, wherein, in the at least one deployed position, the first portion and the second portion are configured to be positioned at an angle to each other, the frame being configurable to a plurality of modes, each mode being adapted to a preselected function;

wherein a substantial part of the first portion is substantially plane and the second portion is substantially curved;

wherein the coupling is configured to allow the first portion and the second portion to rotate such that from a starting position of 90 degrees the distal second ends of the first portion and the second portion collide when the distal second ends are rotated away from each other; and wherein, in at least one of the plurality of modes, the first portion and the second portion are configured to form an at least partially enclosed compartment, for carrying a foreign object.

* * * * *